United States Patent [19]

Bartilucci et al.

[11] Patent Number: 5,009,767

[45] **Date of Patent: * Apr. 23, 1991**

[54] RECYCLE OF OILY REFINERY WASTES

[75] Inventors: Mark P. Bartilucci, S. Melbourne, Australia; Grant G. Karsner, Voorhees Township; William J. Tracy, III, Sewell, both of N.J.

[73] Assignee: Mobil Oil Corporation, Fairfax, Va.

[ * ] Notice: The portion of the term of this patent subsequent to Oct. 17, 2006 has been disclaimed.

[21] Appl. No.: 410,434

[22] Filed: Sep. 21, 1989

Related U.S. Application Data

[63] Continuation-in-part of Ser. No. 151,380, Feb. 2, 1988, Pat. No. 4,874,505.

[51] Int. Cl.[5] ..... C10G 55/04

[52] U.S. Cl. ..... 208/85; 208/13; 208/48 Q; 208/131; 585/240; 201/20; 201/25

[58] Field of Search ..... 208/131, 48 Q, 46, 85, 208/13; 585/240; 201/2.5, 20, 25

[56] References Cited

U.S. PATENT DOCUMENTS

| | | | |
|---|---|---|---|
| 3,146,185 | 8/1964 | Fella | 208/131 |
| 3,692,668 | 9/1972 | McCoy et al. | 208/13 |
| 3,696,021 | 10/1972 | Cole et al. | 208/13 |
| 3,917,564 | 11/1975 | Meyers | 208/131 |
| 3,962,076 | 6/1978 | Hess et al. | 201/25 X |
| 4,118,281 | 10/1978 | Tan | 208/13 |
| 4,666,585 | 5/1987 | Figgins et al. | 208/131 |
| 4,839,021 | 6/1989 | Roy | 208/131 X |
| 4,874,505 | 10/1989 | Bartilucci et al. | 208/131 |

*Primary Examiner*—Anthony McFarlane
*Attorney, Agent, or Firm*—Alexander J. McKillop; Charles J. Speciale; Malcolm D. Keen

[57] ABSTRACT

Petroleum refinery waste stream sludges are recycled by segregating the sludges according to their oil content. Sludges of high oil content are developed and then injected into a delayed coking unit during the coking phase so that they are converted to coke and liquid coking products. High water content sludges are used to quench the coke during the quench phase of the coking cycle, with minimal increases in coke volatile matter. The process increases the capacity of the delayed coking unit to process and recycle refinery waste sludges and produce a coke of lower volatile content.

24 Claims, 3 Drawing Sheets

RECYCLE OF OILY REFINERY WASTES

CROSS REFERENCE TO RELATED APPLICATION

This application is a continuation-in-part of Application of Ser. No. 07/151,380, filed 2 Feb. 1988, now U.S. Pat. No. 4,874,505, which is incorporated in this application by reference.

FIELD OF THE INVENTION

This invention related to a method of recycling waste products from petroleum refineries, especially oily sludges produced during various petroleum refining processes. In particular, the invention relates to a process for recycling petroleum refinery sludges using a delayed coker unit.

BACKGROUND OF THE INVENTION

Waste products are produced during the refining of petroleum, for example, heavy oily sludges, biological sludges from waste water treatment plants, activated sludges, gravity separator bottoms, storage tank bottoms, oil emulsion solids including slop oil emulsion solids or dissolved air flotation (DAF) float from flocculation separation processes. Waste products such as these may create significant environmental problems because they are usually extremely difficult to convert into more valuable, useful or innocuous products. In general, they are usually not readily susceptible to emulsion breaking techniques and incineration which requires the removal of the substantial amounts of water typically present in these sludges would require elaborate and expensive equipment. For this reason, they have often been disposed of in the past by the technique known as "land farming" by which the sludge is worked into the land to permit degradation by bacterial action. Resort to these methods has, however, become more limited in recent years with increasingly stringent environmental controls and increases in the amount of such waste products produced in refineries. In particular, the use of land farming is likely to encounter more stringent regulation in the future because of the potential for pollution, both of ground water and the air.

A process for disposing of petroleum refinery sludges and other wastes is disclosed in U.S. Pat. No. 3,917,564 (Meyers) and this process has been shown to be extremely useful. In it, sludges or other by-products of industrial and other community activity are added to a delayed coker as an aqueous quench medium during the quench portion of the delayed coking cycle. The combustible solid portions of the byproduct become a part of the coke and the non-combustible solids are distributed throughout the mass of the coke so that the increase in the ash content of the coke is within commercial specifications, especially for fuel grade coke products. As shown in U.S. Pat. No. 3,917,564, sludges which may be treated by this method include petroleum refinery slop emulsions, biological sludges and sludges containing large amounts of used catalytic cracking catalyst mixed with biological wastes.

Another proposal for dealing with petroleum sludges is disclosed in U.S. Pat. No. 4,666,585 (Figgins) which discloses a process in which petroleum sludges are recycled by adding them to the feedstock to a delayed coker before the quenching cycle so that the sludge, together with the feed, is subjected to delayed coking. This process has the desirable aspect of subjecting the combustible portion of the sludge to the high coking temperatures so that conversion either to coke or to cracked hydrocarbon products, takes place. However, the presence of water in the sludge tends to lower the coking temperature unless compensation is made for this factor, for example, by increasing the operating temperature of the furnace and this may decrease the yield of the more desirable liquid products from the delayed coking process.

In addition, the amount of sludge which may be added to the coker feed is limited by the presence of the relatively large amounts of water in the sludge. As described in the patent, the amount of sludge is limited to 0.01 to 2 weight percent.

As described in U.S. Pat. No. 4,874,505, the waste recycling operation may be improved by segregating refinery sludges and separately injecting them into the delayed coker at different times during the delayed coking cycle: the oily sludges such as slop oils, storage tank sludges and gravity separator skimmings are injected into the coker drum during the coking cycle and the more watery sludges such as DAF float or biosludge are injected during the quench cycle. Reference is made to U.S. Pat. No. 4,874,505 for a full description of the process.

SUMMARY OF THE INVENTION

The present process for the recycling or disposing of sludges enables significantly larger quantities of sludges to be processed with refinery streams in a delayed coking unit. During the processing, the combustible portion of the sludge is converted by coking to coke and lower molecular weight liquid products which may be recovered in the product recovery unit associated with the coker.

According to the present invention the process in which oily sludges and other refinery waste streams are recycled operates by segregating refinery or other sludges into a high oil content waste which is injected into a delayed coking unit during the coking phase of the cycle and a high water content waste which is injected during the quenching phase of the delayed coking cycle. The high oil content waste is preferably subjected to a filtering operation prior to injection into the coker drum in order to remove water as well as components which increase the ash content of the final coke. This process increases the capacity of the delayed coker to process these refinery wastes and sludges and has the potential for improving the quality of the resulting coke obtained from the process. It has the particular advantage that the amount of sludge which may be added to the coker feed for recycling is increased.

THE DRAWINGS

DETAILED DESCRIPTION

Figure 1:
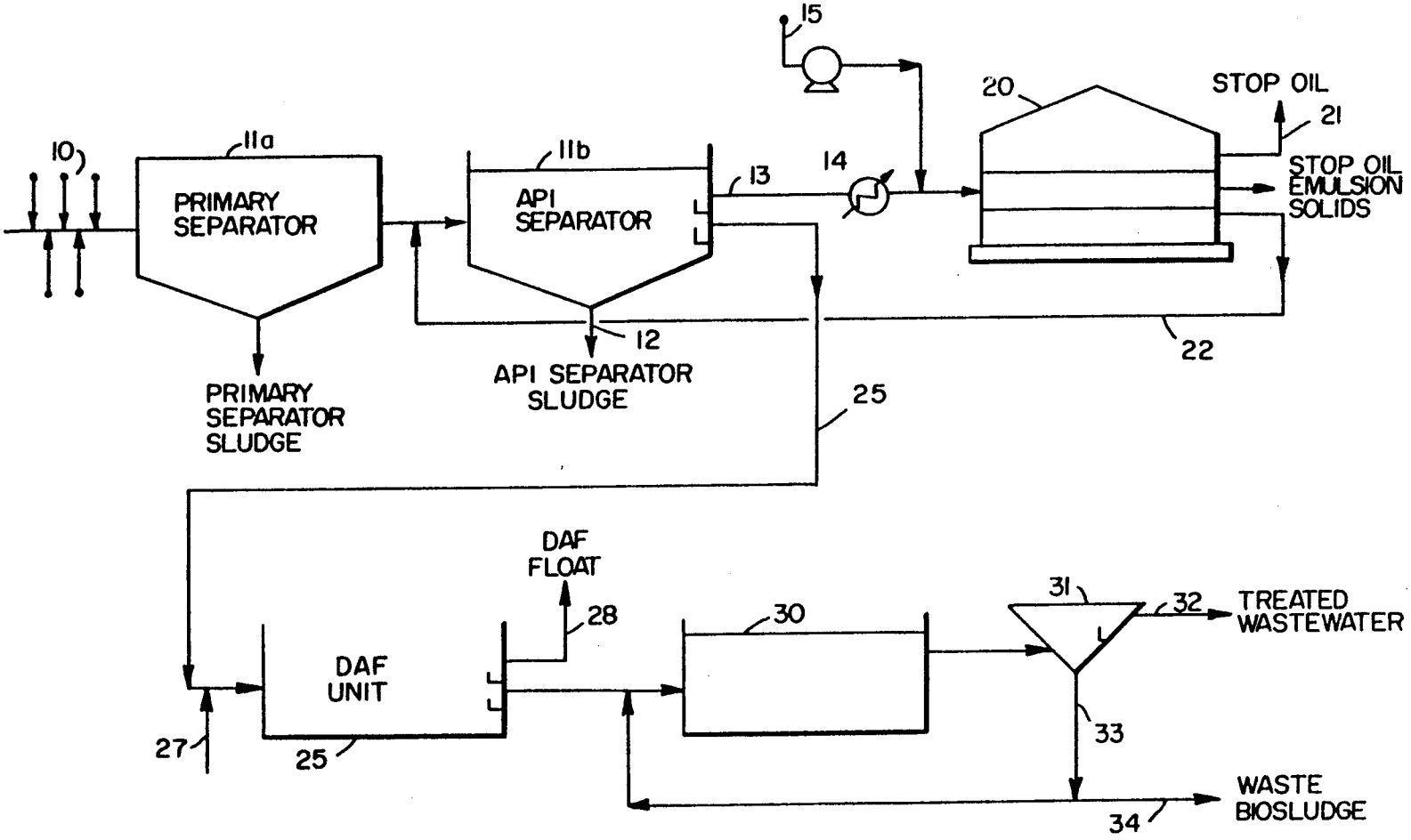
FIG. 1 is a simplified schematic flow diagram of a refinery waste treatment plant which produces refinery sludges.

The present process for recycling petroleum waste streams and other waste products obtained from industrial or community activity is particularly useful for recycling the sludges which are encountered during petroleum refining operations. It is therefore of especial utility for recycling oily sludges, including sludges defined as "solid wastes" by the Environmental Protection Administration. However, it may be employed with a wide range of waste products including biological sludges from waste water treatment plants, such as activated sludges, and other oily sludges including gravity separator bottoms, storage tank bottoms, oil emulsion solids including slop oil emulsion solids, finely dispersed solids or dissolved air flotation (DAF) float from floculation separating processes and other oily waste products from refinery operations. Sludges of this kind are typically mixtures of water, oil, suspended carbonaceous matter together with varying quantities of non-combustible material, including silt, sand, rust, catalyst fines and other materials. These sludges are typically produced in the course of refining operations from storage tank cleaning and in the bottoms of various process units including the API separator.

In the present process, sludges such as these are segregated according to their water content and are then recycled or disposed of using a petroleum refinery delayed coking unit. The delayed coking process is an established process in the refining industry and is described, for example, in U.S. Pat. Nos. 3,917,564, 4,666,585 and 4,874,505, to which reference is made for a disclosure of the delayed coking process and of its use in sludge recovery.

In a typical delayed coking process, a petroleum fraction feed is heated by direct heat exchange with the cracking products in a combination tower in which any light components in the feed are removed by contact with the hot, vaporous cracking products. The feed then passes to the furnace where it is brought to the temperature requisite for the delayed coking process to proceed, typically to temperatures from 700° to about 1100° F. (about 370° to about 595° C.). The heated feed is then fed into a large delayed coking drum under conditions which permit thermal cracking to take place. As the coking drum fills, cracking occurs and lighter constituents of the cracking are removed as vaporous cracking products while condensation and polymerization of aromatic structures takes place, depositing a porous coke mass in the drum which is removed when the drum is full. In a conventional delayed coking unit, two or more coke drums are used in sequence with the feed being fed to each drum in turn during the coking phase of the cycle until the drum is substantially full of coke. The feed is then switched to the next coking drum in the sequence while the first drum is stripped of volatile cracking products by the use of steam, after which the coke is quenched during the quenching phase of the delayed coking cycle and then removed from the coking drum, usually by use of hydraulic cutting equipment.

In the present sludge recycling process, the coking feed, typically comprising a heavy petroleum feedstock e.g. a residual feed, is combined with sludge of high oil content (and, conversely, of low water content) during the coking phase of the delayed coking cycle and subjected to coking conditions to produce cracking products and coke. During the quench phase of the delayed coking cycle sludge of high water content (and, conversely, of lower oil content) is injected into the coker drum to quench the coke, after which it may be removed from the coker drum in the normal way. Initially, therefore, the waste sludges are segregated into a sludge of high oil content and a second sludge of high water content. The sludges may be collected separately according to their water content and stored in separate tanks until they are withdrawn with the high oil content sludge being introduced into the delayed coker with the heavy coking feed and the higher water content sludge injected into the drum during the quench phase of the cycle. In this way, the characteristics of the sludge are matched to the two phases of the delayed coking cycle so as to obtain the best conditions for the effective recycling of the sludges. The high oil content sludge is subjected to the delayed coking conditions so that the oil in the sludge is effectively converted to coke and more valuable, cracked products and the high water content sludge is used during the quench phase of the cycle when it is highly effective as a quench medium. The coking phase of the cycle is therefore carried out with relatively less water and because of this, the conditions during the coking phase of the cycle may be maintained at more optimal values, with a consequent improvement in coke product quality. Similarly, the relatively lower oil content of the sludge which is added during the quench portion of the coking cycle reduces the amount of volatile combustible material (VCM) in the coke product. Thus, an optimized recycling process is achieved in this way.

Typically, the sludges will be segregated into sludges of relatively high oil content, usually implying a water content of less than 60 to 70 weight percent typically with 10 to 25 weight percent oil and high water content sludges, typically implying a water content greater than 50 wt% and more usually greater than 60 or 70 wt%. The use of high water content sludges with water contents of at least 85% is preferred for the quenching step since the water provides good quenching while the low residual oil content ensures that the VCM content of the product coke is maintained at a low value. Table 1 below shows typical compositions of some common petroleum refinery waste streams. Streams such as the DAF float and biosludge tend to have higher water contents while slop oil emulsions usually have high oil contents, as shown in the Table.

TABLE 1

Typical Sludge Composition

| | Composition (Wt %) | | |
|---|---|---|---|
| | Water | Oil | Solids |
| Slop Oil Emulsion Solids | 40–65 | 15–25 | 15–40 |
| DAF Float | 70–95 | 5–15 | 5–15 |
| Biosludge | 85–95 | 0 | 5–15 |
| API Separator Bottoms | 55–70 | 10–20 | 15–25 |

FIG. 1 shows a typical refinery waste treatment system from which the sludges of both types may typically be obtained from processing in the delayed coker.

Upstream water, oil, solids, and chemicals from leaks, spills, tank water drawoffs, process units, maintenance and repair activities are sent to the refinery waste collection system at numerous points 10. Primary treatment invariably involves gravity differential, API (American Petroleum Institute) separators 11*a*, 11*b* for oil/water/solids separation. During this process, oil rises to the surface, and sediment settles to the bottom.

The oil phase (API Skimmings) normally contains two fractions. One fraction is carried in suspension in the form of solids-oil-water emulsions and the other fraction floats on the surface of the water as free oil. The API separator bottoms is an oily residue with a relatively high solids content which can be withdrawn from the bottom of separator 11 through line 12. The skimmed oil is collected as one stream and withdrawn through line 13, although some systems have more than one point of oil-drawoff.

The skimmed oil emulsion containing water and solids is sent through line 13 to a slop oil system which is normally utilized to separate a relatively dry slop oil for recycle back to the refinery. The oily emulsion is heated in heat exchanger 14 to assist in breaking the emulsion and additional demulsifiers may be added through line 15. Separation takes place in slop oil treatment tank 20 which permits the emulsion to settle into separate phases which can be withdrawn separately. A slop oil of high oil content may be withdrawn through line 21 and a lower water phase which is recycled to API separator 11 through recycle line 22. Normally, a portion of the slop oil is an unbreakable emulsion (under the conditions used) which separates as a middle layer in treatment tank 20 and which may be removed through line 23. This layer is usually referred to as slop oil emulsion solids and is suitable for injection into the coker drum during the coking phase of the cycle as an oils waste (see Table 1 above).

The water effluent from the gravity differential separation system contains dispersed oil and suspended solids which are removed in a subsequent series of treatments, commencing with DAF (Dissolved Air Flotation) separator 25 to which the API separator aqueous effluent is led through line 26 with flocculating agent preferably introduced through inlet 27. The DAF unit increases the phase segregation velocity of the dispersed oils and solids in the presence of the added chemical agents under the influence of the air bubbles which are injected into the emulsion. The oil and solids become concentrated in a scum or float layer known as DAF Float. Alternative types of flotation unit include, for example, Induced Air Flotation Units (IAF).

The DAF Float may be skimmed off the emulsion and removed through line 28 with the water effluent being passed through line 29 to secondary treatment, conventionally by biological process such as the Activated Sludge process in tank 30. The effluent from the biotreatment is passed to clarifier 31 from which a supernatant treated wastewater may be withdrawn through line 32 with the heavier biosludge being returned through recycle line 33. Excess biosludge may be removed through waste line 34 for disposal, for example, by use during the quench phase of the delayed coking cycle in the present process.

As described in U.S. Pat. No. 4,874,505, the high oil content sludges such as the slop oil, slop oil emulsion solids and API separator bottoms may be effectively recycled by sending them to the delayed coker with the coker feed during the coking portion of the coker operation cycle. The more watery sludges, by contrast, should be used as quench when their high water content provides good quenching for the hot coke while their low oil content enables the volatile combustible matter (VCM) to be maintained at a low level.

In order to optimize conditions during the coking it is preferred to increase the oil content of the sludge which is injected during this phase, typically from 10–25 weight percent to at least 50 weight percent or even higher e.g. 60, 70 or 85 weight percent. This may be achieved by subjecting the oily sludge to an initial dewatering step by heating and flashing in a conventional vapor/liquid separator. After removal from the separator, the dewatered sludge, typically with less than 50 weight percent water, may be added directly to the coking feed from the coking furnace, for example, at a point between the furnace and the delayed coking drum or directly into the drum. However, alternative sequences may be employed, for example, the cold sludge may be injected directly into the delayed coking drum or it may be combined with the coking feed before or after the furnace. It is generally preferred to add the oily sludge after the furnace in order to decrease furnace coking.

A preferred alternative is to subject the oily sludges to a dewatering operation prior to injection into the coker, suitably by filtering the sludge. The filtering may reduce the water content of the sludges significantly while effecting a corresponding increase in the oil and solids content, which renders it more suitable for injection with the coker feed. The increased solids content need not increase the ash content of the coke at all since the objective of the filtering process is to dewater the sludge prior to injection so that less water reaches the coker for a given amount of sludge; thus, the same amount of sludge may be recycled but the dewatering operation results in less water intruding into the coking process with consequent improvements in the coking conditions. In addition, the aqueous phase will contain a significant proportion of dissolved mineral salts e.g. sodium chloride, and these are removed with the water in the filtration step, ultimately leading to a lower ash content for the coke.

Suitable filters which may be used include belt filters and pressure filters (filter presses) and rotary vacuum filters, of which the belt filter is preferred because of its continuous mode of operation. The preferred type of belt filter employs two co-acting porous belts which receive the sludge in an inlet section of relatively wide cross section and then subject the sludge to compression by decreasing the gap between the belts so that a filtrate mainly comprising water is squeezed out through the belt, leaving a filter cake of reduced water content which can be ejected from the end of the belt nip and conveyed to the coker.

Various types of filter which may be used for the dewatering operation, including the belt filter, pressure filter, filter press, rotating leaf filter, continuous pressure filter are described in *Encyclopedia of Chemical Technology*, Kirk-Othmer, Third Edition, (Vol. 10) 284–337, to which reference is made for a description of such filters.

Centrifuging may be used as an alternative to filtration but is generally not preferred in view of the difficulties of maintaining continuous operation with a substantial throughput.

The integration of the filtration step into the present process is discussed in greater detail below.

All or a portion of the dewatered oily sludge may be preheated prior to being introduced into the delayed coker unit, for example, to increase fluidity or maintain the desired drum inlet temperature, typically to a temperature of at least 180° F. (about 80° C.), and more usually to a temperature of at least 350° F. Pre-heat temperatures of about 400° F. should be adequate for ensuring that the feed to the coker does not become excessively cooled by the addition of the sludge. If the dewatering step is used, it is preferred to mix the sludge with a hydrocarbon liquid after dewatering in order to increase the flowability of the dewatered sludge. Refinery streams such as coker fresh feed, coker heavy gas oil (CHGO), coker light gas oil, FCC clarified slurry oil (CSO) or heavy refinery slop oil may be used for this purpose. In most cases, the solids content of the filter cake should be reduced to a value between about 10 and 20 weight percent e.g. about 15 weight percent, to bring the dewatered sludge into a condition in which it can readily be handled in conventional refinery equipment.

The mixture of coking feed and oily sludge and any added oil will normally be introduced into the coke drum at temperatures between about 850° and about 950° F. (about 455° to 510° C.), usually about 900° F. (about 480° C.).

The most preferred mode of operation of the process is with filtration of the oily sludge to reduce the water content, followed by heating of the filter cake to about 200°–450° F., (about 93° to 230° C.), typically to about 350° to 400° F.(about 175° to 205° C.), while mixed with additional oil to preserve fluidity e.g. to 15 percent solids. This slurry is then mixed with the coker feed from the furnace for injection into the coke drum. The amount of solids in the coker feed entering the drum which is attributable to the sludge is relatively small because the added sludge makes up only a relatively small portion of the feed to the drum. After coking is complete, the watery sludge is used in the quench cycle, as described above. Operation of the process in this manner enables a large quantity of waste sludge to be effectively recycled without an unacceptable adverse effect on the coking operation. Thus, both oily sludges and watery sludges are handled in a manner consistent with environmentally sound practices.

During the coking phase of the delayed coking cycle, the carbonaceous content of the high oil content sludge is converted together with the feed by thermal cracking into coke and vaporous cracking products which are recovered in the fractionator connected to the delayed coke drum in the product recovery section of the unit. In this way, the oily sludge is effectively recycled and converted to useful products.

The high water content sludges are used during the quench phase of the delayed coking cycle by being fed directly into the coke drum to act as quench for the hot coke in the drum. The introduction of the high water content sludge into the drum may be employed in addition to or instead of the steam or water typically used for quenching the coke. The high water content sludges act as effective quenching media and their relatively low oil content ensures that the volatile combustible matter (VCM) content of the coke product is held at an acceptable low level.

By injecting the sludges of differing water content at different stages of the coking cycle, a greater total amount of sludge may be recycled than would be the case if attempts were made to inject all the sludge at one time. The amount of oily sludge which can be tolerated during the coking phase will, of course, depend upon the general operating conditions of the coker (feed, temperature, furnace capacity) as well as sludge characteristics (solids content especially metals, water content) and the desired coke product characteristics, especially metal content; pretreatment conditions such as dewatering and addition of oils also affect the amount of sludge which can be added. Typically, oily refinery sludges can be added at a rate of at least 0.5 bbl/ton coke product during the coking phase with additional high water content sludge injected during quenching to give a total recycling capacity of at least 1 bbl/ton coke or even higher e.g. 1.5 or 2 bbl/ton coke produced. Based on feed to the drum, the amount of sludge will be typically about 300–500 Bbl per 10,000 Bbl feed. Because the oily sludge components are coked together with the feed during the coking phase of the cycle, the increase in the VCM levels of the coke will themselves be small: increases in VCM levels below 1 weight percent e.g. 0.5 weight percent may be obtainable. In favorable cases, electrode grade coke may be produced whilst retaining a significant sludge recycling capacity.

Figure 2:
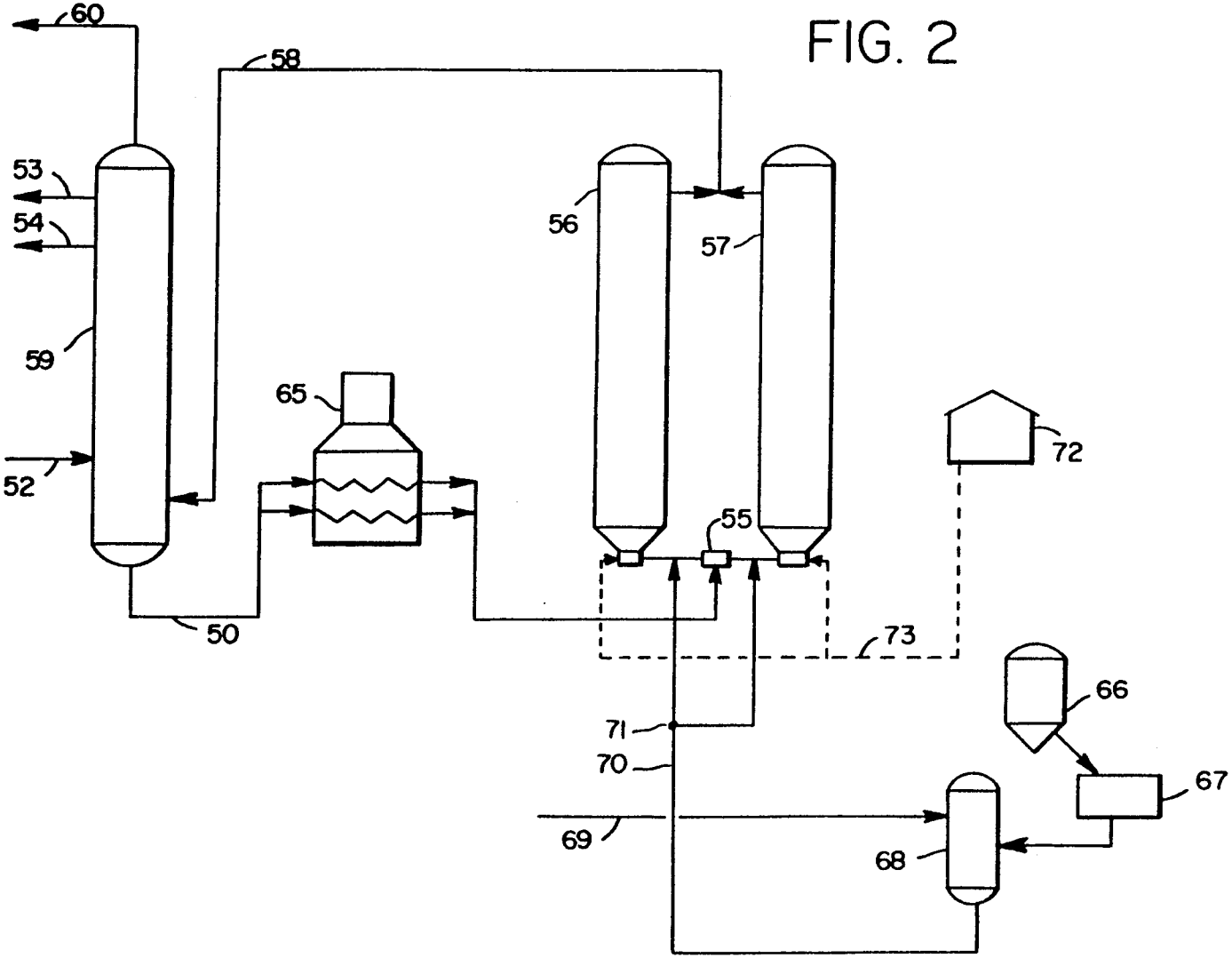
FIG. 2 is a simplified schematic flow diagram showing a delayed coking unit in which the present process may be carried out.

A wide variety of petroleum refinery sludges and other waste products resulting from industrial and community activities may be effectively recycled in the delayed coking unit in a way which permits unit operating conditions to be optimized so as to produce a valuable product whilst handling and recovering these waste products in an environmentally sound and acceptable manner. Segregation of the sludges followed by sequenced injection as described above increases the capacity of the delayed coker to process these waste products: the temperature drop associated with the injection of sludge during the coking phase is reduced by limiting the quantity of water introduced into the coke drum. Conversely, the VCM content of the coke product is reduced by limiting the quantity of oil which is introduced to the coke drum at the reduced temperatures associated with the quench phase of the cycle. Although the exact values of the oil and water contents of the sludges at the times they are injected into the coker drums is not critical, the best results will clearly be obtained when the sludge injected during the coking phase has a high oil content and, conversely, a low water content, while the sludge used for quenching should have a high water content and a correspondingly low oil content. A preferred mode of operation is illustrated in FIG. 2. Delayed coker drums 56 and 57 are arranged so that feed may be directed to either or both of them through valve 55. Vaporous products pass through conduit 58 to combination tower 59 for making the appropriate product cuts, for example, with coker gasoline and gas oil exiting conduits 53 and 54 and gas through line 60. Fresh coker feed enters the tower through inlet 52. The bottoms fraction comprising unvaporized feed and unconverted coking products passes through conduit 50 to heater 65 and then to coke drums 56 and 57 where it is coked.

Refinery waste sludges from the waste treatment plant are segregated according to their oil and water contents and are maintained in storage facilities. A high oil content petroleum sludge is withdrawn from storage tank 66 and is dewatered by filtering unit 67 or, alternatively, by a heat exchanger followed by a flash drum and fed to slurry drum 68 where it is mixed with a petroleum stream, such as a gas oil e.g. CHGO or slurry oil e.g. CSO, fed through conduit 69 to reslurry the filter coke which is then introduced through conduit 70 and valve 71, to the inlets of coke drums 56, 57. The slurry may be heated in a separate heater prior to injection into the drum or, alternatively the feed may be heated to a higher temperature in the furnace to supply sufficient heat to ensure satisfactory coking. The filtrate (mainly water) from the filter is partly recycled to the filter to provide belt cleaning; the rest may be sent to an appropriate unit in the waste water treatment plant depending on its composition e.g. to the DAF unit.

Sources of high water content petroleum sludges (not shown) discharge into storage tank 72 for temporarily storing the high water content sludge in which is then used as a quench medium in coke drums 56, 57 during the quenching phase of the process by injection through line 73. Coke drums 56, 57 may be operated simultaneously although it is preferable to alternate the introduction of delayed coker feed into one drum while coke is removed from the other drum.

Other waste streams may also be introduced separately to the coker drum or mixed with the heavy hydrocarbon coker feed and/or high oil content sludge e.g. catalyst fines, if these may be incorporated into the coke.

Coke recovery proceeds by removal of the top and bottom heads from the drums and cutting of the coke by hydraulic jets. The coke so cut from the drum appears in sizes ranging from large lumps to fine particles. The coke so obtained may have a higher quality (lower content of volatile combustible matter (VCM) than that previously obtainable. If the coke is of appropriate quality it may be calcined or, alternatively, used as fuel grade coke.

Figure 3:
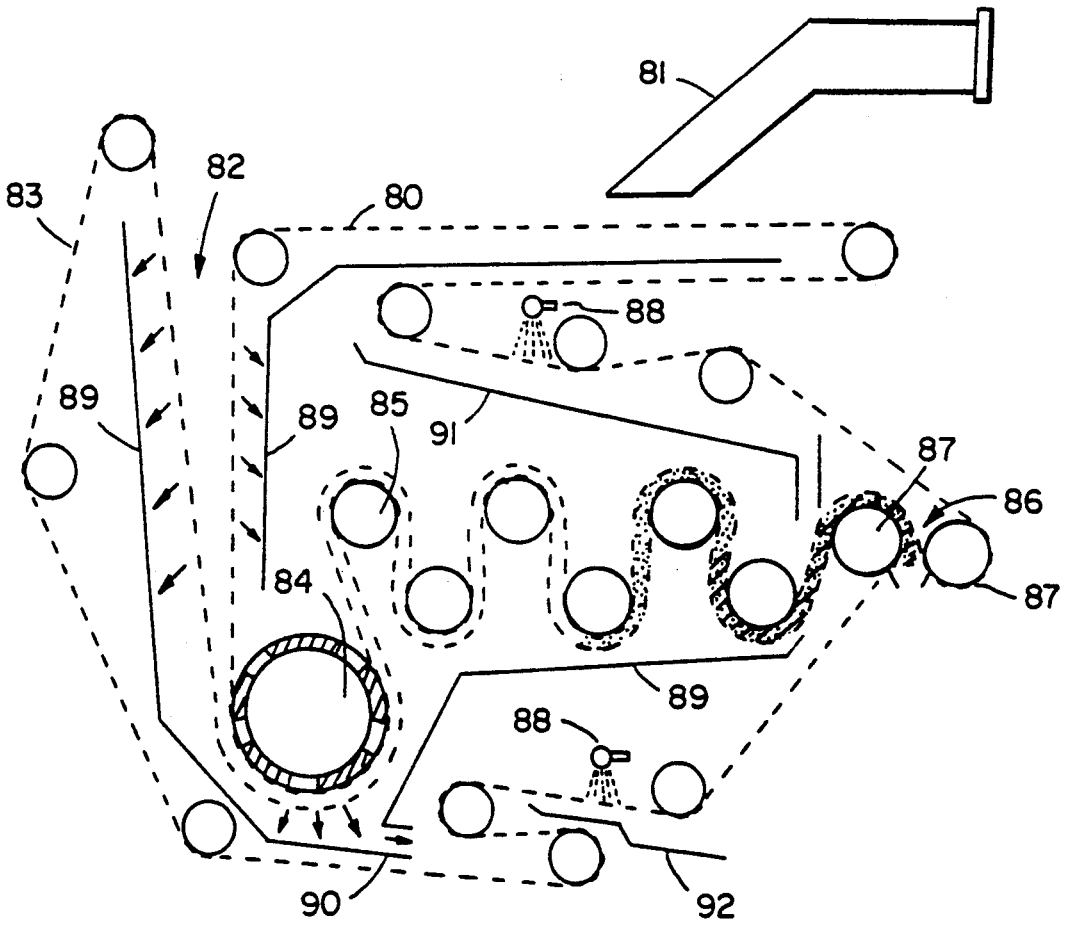
FIG. 3 is a simplified schematic flow diagram showing a sludge filter which may be used for dewatering sludges.

A typical belt filter which may be used for the dewatering of the oily sludge prior to injection into the coker is shown in FIG. 3. The sludge is ejected onto circulating porous belt 80 through inlet 81. Initial dewatering occurs as water passes by gravity from the sludge through the belt in its horizontal run under inlet 81. The sludge is then carried into a V-shaped inlet section 82 defined by belt 80 and a second circulating belt 83. Both belts are porous, typically of canvas and permit the liquid content of the sludge to pass through while retaining the solids and most of the oil. As the gap between the belts becomes progressively narrower in zone 82, water is progressively removed and the sludge decreases in volume. Compression of the sludge is initiated as the belts pass over hollow perforated roll 84 which may be internally fitted with an air pressure supply to increase pressure across the filter cake between the belts. Further compression of the filter cake continues as the belts follow a sinuous course over rolls 85 (one indicated); at the same time some shear is imparted to the cake which helps to free it from the belts and this may be assisted by a slight speed differential between the belts. The dewatered cake is ejected from the belt nip at 86 as the belts pass over return rolls 87. From return rolls 87 the belts pass to cleaning stations where they are subjected to reverse flow cleaning from high pressure sprays 88 which assist in removing obstructive material from the belts. The sprays are suitable water sprays using filtrate water from the filter unit or, alternatively, from another source such as the DAF separator. The aqueous filtrate from the sludge is collected by trays 89 and passes to filtrate outlet 90 from which it may be passed to a suitable point in the waste water treatment unit. The belt wash water is collected separately in trays 91 and 92 with the water from upper tray 91 entering the main filtrate collection tray system over tray 89.

The effect of the present recycling process is illustrated by a comparison showing calculated estimates of coke volatile combustible matter (VCM) content which could be obtained by injecting sludges at a relatively high rate of 1.3 bbl of sludge (total) per ton of coke, both with and without segregation. Example 1 below illustrates the effect of injecting sludge without segregation according to water content and Example 2 shows the effect of segregating the sludge according to water content. In Example 2, the results are derived by assuming that the sludge segregation is made to produce two sludges having compositions as follows (weight percent):

| | Water | Oil | Solids |
|---|---|---|---|
| High Oil Sludge | 40 | 50 | 10 |
| High Water Sludge | 88 | 3 | 9 |

The high oil content sludge is then assumed to be subjected to an optional pretreatment step of dewatering and reslurrying with a hydrocarbon stream (CHGO) to a 0/90/10 composition (water/oil/solids, weight percent) followed by preheating prior to injection into the coker. In addition, the VCM content is estimated by assuming that all the oil in the sludge which is injected during the quenching remains on the coke as VCM. The calculated comparisons are shown in Table 2 below.

TABLE 2

| | Sludge Volume (bbl/ton coke) | Sludge Composition (Wt. %) | | | Coke VCM Inc. (Wt %) |
|---|---|---|---|---|---|
| | | Water | Oil | Solids | |
| Comp. Ex. 1 (No Segr.) | | | | | |
| During Quench | 1.3 | 66 | 25 | 10 | 5.8 |
| During Coking | — | — | — | — | — |
| Total | 1.3 | 66 | 25 | 10 | 5.8 |
| Ex. 2 (With Segr.) | | | | | |
| During quench | 0.7 | 88 | 3 | 9 | 0.4 |
| During Coking | 0.6 | 0 | 90 | 10 | 0 |
| Total | 1.3 | 88 | 93 | 19 | 0.4 |

As shown in Table 2, the injection of sludge during the quench cycle (Example 1) results in a relatively high coke VCM content which is significantly reduced if the sludge is segregated and injected according to water content during the two portions of the coking cycle (Example 2). For this reason, the amount of sludge which may be injected without segregation during the quench portion of the cycle may require to be limited to lower values in actual, commercial operations. However, by segregating the sludges and injecting the high oil content sludges during the coking phase of the cycle, relatively higher amounts of sludge can be recycled, as shown by Example 2.

The effect of dewatering the oily sludge prior to injection into the coker is shown by the following comparisons, which assume a delayed coker unit of 8 drums with a total capacity of 50,000 BPSD. In all case studies below, the coker feed has a gravity of 6.8 API and a CCR of 19 wt. percent. Coker yield is 29.5 wt. percent, at a coke make of 2637 tons/day.

Case 1: This case assumes that no sludge is added to the coker; the coker is run for maximum anode quality coke.

Case 2A: This case adds sludge to the coker during coking and quench (without filtering) in quantities which enable anode grade coke to be maintained; all coker capacity is employed for anode grade coke.

Case 2B: As Case 2A but with five drums given to anode coke and three to fuels coke.

Case 3A: As Case 2A but the oily sludge added during coking is pre-filtered to a solids content of 25 wt. percent. The sludge is a composite of oily sludges. All coke drums are given to anode coke production.

Case 3B: As Case 3A but with only 6 out of 8 drums given to anode coke.

The comparisons are as shown in Table 3 below.

TABLE 3

| | Coking Studies | | | | |
|---|---|---|---|---|---|
| | Case No. | | | | |
| | 1 | 2A | 2B | 3A | 3B |
| Sludge Mngmnt. | Outhaul | To Coker-as rec'd | | Prefilter | |
| Coking Mode | Max Anode | Max Anode | Blocked Mix | Max Anode | Blocked Mix |
| Coke drums: | | | | | |
| Total | 8 | 8 | 8 | 8 | 8 |
| On anode | 8 | 8 | 5 | 8 | 6 |
| On fuels | 0 | 0 | 3 | 0 | 2 |
| Sludge to coker, Bbl/day | | | | | |
| DAF Float | 0 | 662(Q) | 1750(Q) | To filter | |
| Slop Oil Em. Solids | 0 | 442(C) | 1125(C) | To filter | |
| API Bottoms | 0 | 0 | 62(Q) | 54(Q) | 62(Q) |
| Belt Press Cake | 0 | 0 | 0 | 249(C) | 287(C) |
| Anode coke: | | | | | |
| Tons/day | 2241 | 2241 | 1401 | 2241 | 1681 |
| Ash, wt. pct. | 0.15 | 0.30 | 0.15 | 0.30 | 0.15 |
| VCM incr. | 0 | +0.3 | 0 | +0.1 | 0 |
| Fuels Coke: | | | | | |
| Tons/day | 396 | 396 | 1236 | 396 | 956 |
| Ash, wt. pct. | 0.15 | 0.30 | 1.05 | 0.3 | 0.63 |
| VCM incr. | 0 | +0.30 | +2.0 | +0.1 | +0.15 |
| Sludge Reduction Factor, % | 0 | 31 | 100 | 87 | 100 |

Notes:
1. Coke quantities not credited for weight added in sludge weight.
2. (Q) Sludge added in quench.
3. (C) Sludge added in coking.

For the purpose of these case studies the compositions employed as a basis for calculation were as shown in Table 4 below.

TABLE 4

| | Sludge Properties | | | |
|---|---|---|---|---|
| | Sp. Gr. | Water | Oil | Solids |
| DAF Float | 1.03 | 86 | 8 | 6 |
| Slop Oil Em. Solids | 1.02 | 72 | 20 | 8 |
| API Bottoms | 1.13 | 73 | 6 | 21 |
| Belt Cake | 1.15 | 60 | 15 | 25 |

Note:

The solids content of the filter cake (25%) is lower than the amount which would be obtained if all the solids from the feeds going into the filter were to be retained. The reason for this is that some of the feed solids will pass through the filter and be recycled to the units upstream of the filter e.g. the DAF unit, with the result also that the solids circulation rates in these streams are increased correspondingly.

The case studies show that at a comparable sludge reduction factor (Cases 2B, 3B) it is possible to increase the production of anode grade coke by operating in a blocked mix fashion without exceeding acceptable impurity levels in the coke. If the coker is operated for maximum anode coke production i.e. without using fuels coke as a sink for ash-producing impurities, the sludge reduction factor is markedly higher when the pre-filtration is used (Cases 2A, 3A ). Thus, the present process permits significant increases in sludge recycling to be effected.

We claim:

1. A process for disposing of petroleum containing sludge comprising:

(i) segregating waste oil-containing sludges into a first sludge and a second sludge, the first sludge being of high oil content relative to the second sludge and the second sludge being of high water content relative to the first sludge;

(ii) dewatering the first, high oil content sludge;

(iii) introducing the dewatered sludge into a delayed coking drum under delayed coking conditions in the presence of a liquid coker hydrocarbon feedstock to form coke;

(iv) introducing the second, high water content sludge into a delayed coking drum to quench the coke formed in the coking drum.

2. A process according to claim 1 in which the high oil content sludge contains from 15 to 25 percent oil.

3. A process according to claim 2 in which the high water content sludge contains at least 80 percent water.

4. The process of claim 1 in which the dewatered sludge is slurried with oil prior to mixing with the coker feed for introduction into the delayed coker.

5. The process of claim 4 in which the dewatered sludge is slurried with oil to a solids content of from 10 to 20 weight percent prior to mixing with the coker feed for introduction into the delayed coker.

6. The process of claim 1, in which the first, high oil content sludge contains less than 70% by weight of water.

7. The process of claim 1, in which the first, high water content sludge contains at least 80% by weight of water.

8. The process of claim 1, in which the delayed coking conditions include a coking temperature of from about 850° F. to about 950° F.

9. The process of claim 1, in which the high oil content sludge comprises slop oil emulsion solids or API (American Petroleum Institute) separator skimmings.

10. The process of claim 1, in which the high water content sludge is a biosludge or DAF float (Dissolved Air Flotation) sludge or a mixture of these.

11. The process of claim 1, in which steam is introduced intermediate steps (iii) and (iv) to strip volatiles in the coker drum.

12. A process for disposing of petroleum refinery sludges in a delayed coker by introducing a hydrocarbon coker feedstock into a delayed coking drum under coking conditions to produce delayed coke in the drum and quench coke produced in the drum, in which a first, dewatered petroleum of high oil content relative to a second sludge is the coker feedstock introduced into the delayed coking drum and subjected to delayed coking in the coking drum to form coke, and quenching the coke in the coking drum with the second sludge of which is of higher water content relative to the first sludge.

13. The process according to claim 12 in which the dewatered high oil content sludge contains 15–25 weight percent oil.

14. A process according to claim 12 in which the second, high water content sludge contains at least 80 percent water.

15. A process for disposing of petroleum refinery sludges in a delayed coker by introducing a liquid hydrocarbon coker feedstock into a delayed coking drum under delayed coking conditions to produce delayed coker in the drum and quenching the coke produced in the drum, which comprises:

(i) dewatering a first, refinery sludge of high oil content relative to a second refinery sludge which is of high water content relative to the first sludge by filtering the sludge to remove water from it;

(ii) introducing the dewatered sludge into a delayed coker drum with coking feed;

(iii) subjecting the dewatered sludge and coking feed to coking conditions in the coking drum to form delayed coke;

(iv) quenching the coke in the drum with the second refinery sludge of higher water content relative to the first sludge.

16. A process according to claim 15 in which the first, refinery sludge of high oil content comprises API (American Petroleum Institute) separator skimmings, slop oil or slop oil emulsion solids.

17. A process according to claim 15 in which the sludge of high oil content is filtered on a continuous belt filter.

18. A process according to claim 15 in which the refinery sludge of higher water content comprises DAF (Dissolved Air Flotation) float or a biosludge.

19. A process according to claim 15 in which the dewatered sludge is slurried with an oil prior to injection into the coking drum.

20. A process for disposing of petroleum refinery sludge in a delayed coker unit while producing fuels grade coke and anode grade coke, which process comprises:

(i) introducing a liquid hydrocarbon coker feedstock into a delayed coking drum for anode grade coke production and coking the feed under delayed coking conditions and quenching the coke produced in the drum to produce delayed anode grade coke in the drum, (ii) dewatering a first refinery sludge of high oil content relative to a second refinery sludge by filtering the sludge to remove water from it;

(iii) introducing the dewatered sludge into a delayed coker drum with coking feed;

(iv) subjecting the dewatered sludge and coking feed to coking conditions in the coking drum to form delayed fuels grade coke;

(v) quenching the fuels grade coke in the drum with the second refinery sludge of higher water content relative to the first sludge.

21. A process according to claim 20 in which the dewatered sludge is preheated to a temperature of from 200° to 500° F. prior to being mixed with the coker feed.

22. A process according to claim 20 in which the first, high oil content sludge is dewatered by filtration.

23. A process according to claim 20 in which the the dewatered sludge is slurried with oil to a solids content of 10 to 20 weight percent prior to being mixed with the coker feed.

24. A process according to claim 20 in which the first refinery sludge of high oil content comprises API (American Petroleum Institute) separator skimmings, slop oil or slop oil emulsion solids and the second sludge of relatively high water content comprises DAF (Dissolved Air Flotation) float or a biosludge.

* * * * *

UNITED STATES PATENT AND TRADEMARK OFFICE

CERTIFICATE OF CORRECTION

PATENT NO. : 5,009,767

DATED : April 23, 1991

INVENTOR(S) : M.P. Bartilucci, et al.

It is certified that error appears in the above-identified patent and that said Letters Patent is hereby corrected as shown below:

On the title page item [75]:

Inventors - "Township" should be --Townshnew--

Col. 13, claim 12, line 8, "introducing a" should be --introducing a liquid--

Col. 13, claim 12, line 10, "coking conditions" should be --delayed coking conditions--

Col. 13, claim 12, line 11, "and quench" should be --and quenching the--

Col. 13, claim 12, line 12, "dewatered petroleum" should be -- dewatered petroleum sludge--

Col. 13, claim 12, line 13, "is the coker" should be --is added to the coker--

Col. 13, claim 15, line 29, "coker" should be --coke--

Col.14, claim 20, line 11, "sludge" should be --sludges--

Signed and Sealed this

First Day of December, 1992

*Attest:*

*Attesting Officer*

DOUGLAS B. COMER

*Acting Commissioner of Patents and Trademarks*